US010920359B2

(12) United States Patent
Piekarski et al.

(10) Patent No.: US 10,920,359 B2
(45) Date of Patent: Feb. 16, 2021

(54) AGITATOR FOR A LAUNDRY WASHING MACHINE

(71) Applicant: Electrolux do Brasil S.A., Curitiba (BR)

(72) Inventors: Marcelo Piekarski, Curitiba (BR); Luiz Carlos Pazinato, Curitiba (BR); Fabiano Costi, Curitiba (BR); Oscar Luiz Madalena, Curitiba (BR); Eduardo Orthmann, Curitiba (BR); Eduardo De Menezes Lino Modesto, Curitiba (BR); Vicente Marconcin Vanhazebrouck, Curitiba (BR); Adriano Bonatto Cardozo, Curitiba (BR)

(73) Assignee: ELECTROLUX DO BRASIL S.A., Curitiba (BR)

( * ) Notice: Subject to any disclaimer, the term of this patent is extended or adjusted under 35 U.S.C. 154(b) by 288 days.

(21) Appl. No.: 15/959,916

(22) Filed: Apr. 23, 2018

(65) Prior Publication Data

US 2018/0313022 A1 Nov. 1, 2018

(30) Foreign Application Priority Data

Apr. 27, 2017 (BR) ..... 20 2017 008955-5

(51) Int. Cl.

| | |
|---|---|
| ***D06F 39/10*** | (2006.01) |
| ***D06F 13/00*** | (2006.01) |
| ***D06F 37/14*** | (2006.01) |
| *D06F 39/08* | (2006.01) |
| *D06F 13/02* | (2006.01) |

(52) U.S. Cl.

CPC ..... *D06F 39/10* (2013.01); *D06F 13/00* (2013.01); *D06F 37/14* (2013.01); *D06F 37/145* (2013.01); *D06F 13/02* (2013.01); *D06F 39/083* (2013.01); *D06F 39/088* (2013.01)

(58) Field of Classification Search

CPC ..... D06F 37/14; D06F 37/145; D06F 39/10; D06F 13/00

See application file for complete search history.

(56) References Cited

U.S. PATENT DOCUMENTS

| | | | | | |
|---|---|---|---|---|---|
| RE18,280 | E | * | 12/1931 | Kirby | D06F 13/00 68/133 |
| 2,228,057 | A | * | 1/1941 | Kirby | D06F 13/00 68/54 |
| 2,722,118 | A | * | 11/1955 | Guthrie | D06F 13/02 68/134 |
| 2,942,444 | A | * | 6/1960 | Abresch | D06F 39/10 68/17 A |
| 2,976,711 | A | | 3/1961 | Smith | |

FOREIGN PATENT DOCUMENTS

| | | | |
|---|---|---|---|
| BR | 102012030892 | A2 | 9/2014 |
| JP | 60111692 | A | 6/1985 |
| MU | 88025241 | U2 | 7/2010 |
| MU | 91031516 | U2 | 12/2015 |

* cited by examiner

*Primary Examiner* — Joseph L. Perrin
*Assistant Examiner* — Kevin G Lee
(74) *Attorney, Agent, or Firm* — RatnerPrestia

(57) ABSTRACT

A laundry washing machine agitator having a base and an elongated hollow body provided with at least one opening for the admission of washing liquid. The base has a plurality of radial openings located in the radial periphery of the base.

5 Claims, 2 Drawing Sheets

AGITATOR FOR A LAUNDRY WASHING MACHINE

This application claims the benefit of and priority to Brazil Patent Application No. 20 2017 008955-5, filed Apr. 27, 2017, which is incorporated by reference herein.

UTILITY MODEL FIELD

This utility model belongs to the field of household utensils and laundry washing machines and relates to a base-mounted laundry washing machine agitator which improves the flow of washing liquid in the area of filtration and the retention of suspended lint in the washing medium of the laundry washing machine's basket.

BACKGROUND OF THE UTILITY MODEL

Washing machines are household, commercial or industrial equipment widely employed to assist in the task of cleaning garments or fabrics in general, due to their practicality and time-saving features provided to the user.

Laundry washing machines are usually provided with a main cabinet, a washing basket and an agitator placed inside the washing basket, the latter responsible for providing the agitation to the laundry inside the basket.

The agitator comprises at least one base and an elongated body situated on said base, so that a rotating movement, in general (but not necessarily) alternating movement of the agitator about a rotating center promotes agitation of the washing liquid and causes textile articles loaded inside the washing basket to be cleaned properly.

Washing liquid is understood to be a mixture of water and any type of soap, bleach, fabric softener or laundry compounds, blended at any ratio. Furthermore, textile articles are understood to mean any type of clothing, towels, sheets or other articles composed of textile material which one wishes to wash with the aid of a laundry washing machine.

The agitator has a base upon which a hollow elongated body is associated. As is known to those skilled in the art, the agitator base has radial vanes that promote the directioning of the washing liquid towards the radial direction and this movement generates an upward flow in the outermost part of the basket and in a downward movement in the central area of said washing basket. The washing liquid that descends in the central area of the washing basket accesses the hollow inner area of the elongated body of the agitator through openings located in its wall.

Said openings in the outermost wall of the elongated body of the agitator are placed in a radial direction so that the flow of washing liquid enters the internal area of the agitator by means of the pressure difference generated by the movement of the agitator, taking a downward direction within the elongated body of the agitator.

Agitation of the washing liquid and the promoted friction on the garments causes lint to be detached from the fabric being washed. The accumulation of lint and grime inside the washing basket made it necessary to develop filters which were able to keep the washing liquid as clean as possible.

Such filters have already been placed in laundry washing machines in the most varied ways. At the beginning of the development of these filtering devices, the manufacturers used a pump to circulate the washing liquid and force it through said filtration elements. As the technique developed, the filtration elements were inserted into the agitator and various devices were developed so that the washing liquid was circulated inside the agitator and the filtration was not compromised.

An example of a washing machine having a filtration system inserted into the agitator is disclosed by the document JPS60111692. This document discloses an agitator comprising openings in its elongated portion and located in a washing basket. The reciprocating rotational movement of the agitator generates centrifugal forces in the washing liquid and causes said liquid from being in the inner part of the basket to move in the radial direction of said basket and, as it approaches the basket wall, the liquid turns in an upward direction. The movement of the washing liquid generated within the washing basket causes a downward movement of the washing liquid in the most central part of the washing basket where the agitator is positioned which is provided with a filtering system therein. The technique disclosed by the document JPS60111692 has been widely used in today's laundry washing machines as it does not require a pump to promote the filtering of lint and grime that have been detached from the washed garments and fabrics.

U.S. Pat. No. 2,976,711 discloses a development analogous to that proposed by the document JPS60111692 and demonstrates that this technique has already been widely explored at a given time.

With the increased capabilities of current laundry washing machines and the need for faster washing, the use of only the forces generated by the agitator base has slowed down the development of this area of the technique as the washing liquid becomes saturated with impurities faster than the filtration systems can remove the dirt.

In an attempt to improve the filtration efficiency of the wash liquid, developers of laundry washing machines have proposed improvements in laundry filters. Some of these improvements are disclosed in the documents BR102012030892, MU9103151-6 and MU8802524-1 which present different forms and constructive arrangements for the filters, in order to increase the filtration area, changing the means of attachment and even the means to facilitate removal and cleaning of the filters.

However, it is noted that the Prior Art does not provide an effective means for increasing the washing flow circulating through the filtration elements. Thus, there is a need to promote a better flow of the washing liquid through the interior of the agitator and hence through the filter within the agitator to cause less lint and grime to be mixed into the garments and fabrics being washed.

OBJECTIVES AND DESCRIPTION OF THE UTILITY MODEL

Thus, it is an object of this utility model to improve the circulation of the washing liquid inside the washing basket.

A further object of this utility model is to improve the filtration capacity of the washing liquid stream.

One or more objects of this utility model mentioned above, among others, are achieved by a laundry washing machine comprising an agitator positioned inside the washing basket of a laundry washing machine, provided with openings to intake the washing liquid to the inner area of the agitator, wherein the agitator comprises the base provided with a plurality of radial openings located on the radial periphery of the base to increase the outflow of the admitted liquid to the inner area of the agitator through the intake openings.

One or more objects of this utility model are also achieved by accommodating a filtration element within the elongated body to provide retention of lint and other undesirable grime for the laundry process of textile articles.

One or more objects of this utility model are also achieved because the elongated body of the agitator comprises outer projections located along its length and extending to the base of the agitator, defining projections for agitation on the base, increasing agitation of the washing liquid inside the washing basket.

One or more objects of this utility model are achieved in that the agitator base comprises a plurality of angularly spaced radial vanes located in the lower portion of the base, the areas defined between each pair of radial vanes being communicated with the radial openings so as to prepare the washing liquid admitted through the intake openings to go back into the washing area.

One or more objects of this utility model are achieved by means of a filtration element which extends along the length of the inner area of the agitator, representing a high filtration area and thus conferring less loss of energy in the flow of the wash.

BRIEF DESCRIPTION OF THE DRAWINGS

The objects, technical effects and advantages of this utility model will be apparent to those skilled in the art from the following detailed description with reference to the accompanying drawings, which illustrate exemplary embodiments, and of optional uses of this utility model.

DESCRIPTION OF THE UTILITY MODEL

Again, it should be pointed out that the constructive arrangement which will be described below for the laundry washing machine agitator, object of this utility model, will be described in accordance with a particular embodiment, but not a limiting embodiment, since its embodiment may be carried out in different ways and variations and according to the application desired by the person skilled in the art.

In order to achieve the proposed objects, this utility model discloses an agitator 1 for laundry washing machines of the type which is loaded through the upper area and which comprises a washing basket. The agitator 1 is placed inside the washing basket and carries out an alternating rotary movement.

Figure 1:
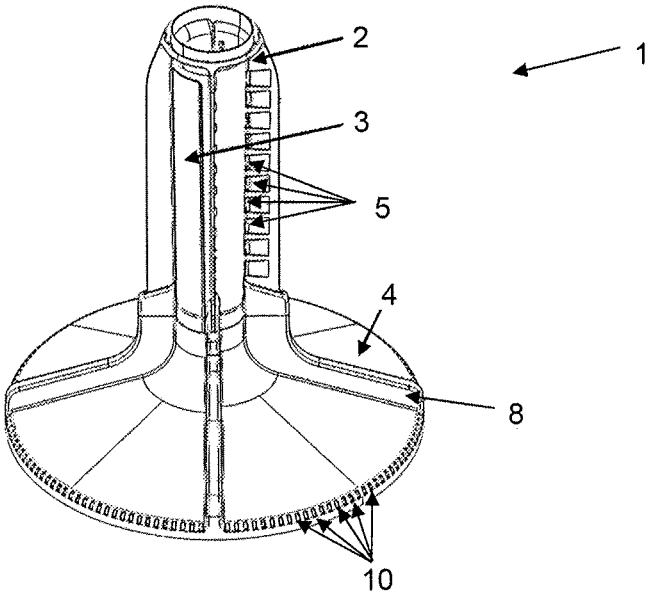
FIG. 1 shows an embodiment of the agitator of this utility model, comprising the intake openings 5 placed in a manner oriented to the rotational movement performed by the agitator during its operation.

As shown in FIG. 1, the agitator 1 of this utility model comprises a base 4 and a hollow elongated body 3 provided with at least one intake opening 5 for admitting the washing liquid into the agitator, and consequently passing through a filtering element 7, where available, as the hollow elongated body 3 extends along a vertical axis. Further, the agitator comprises its base 4 provided with a plurality of liquid outlet openings 10 radially spaced apart between each other.

According to this utility model, the base 4 of the agitator 1 comprises a plurality of radial openings 10 located along the radial periphery of the base 4 and has the function of increasing the outflow of the filtered washing liquid from the interior of the agitator 1 to the washing area inside the washing basket of the laundry washing machine. In this way, the flow of the washing liquid is intensified inside the washing basket and, consequently, the amount of liquid passing through the filtration element is also intensified, increasing the filtration efficiency and improving the washing result.

Each intake opening 5 is defined by a passage communicating between the inner and outer area of the agitator 1, so that each intake opening 5 comprises a rim whose contour comprises geometry defined according to the desired characteristics of the constructive design.

Figure 2:
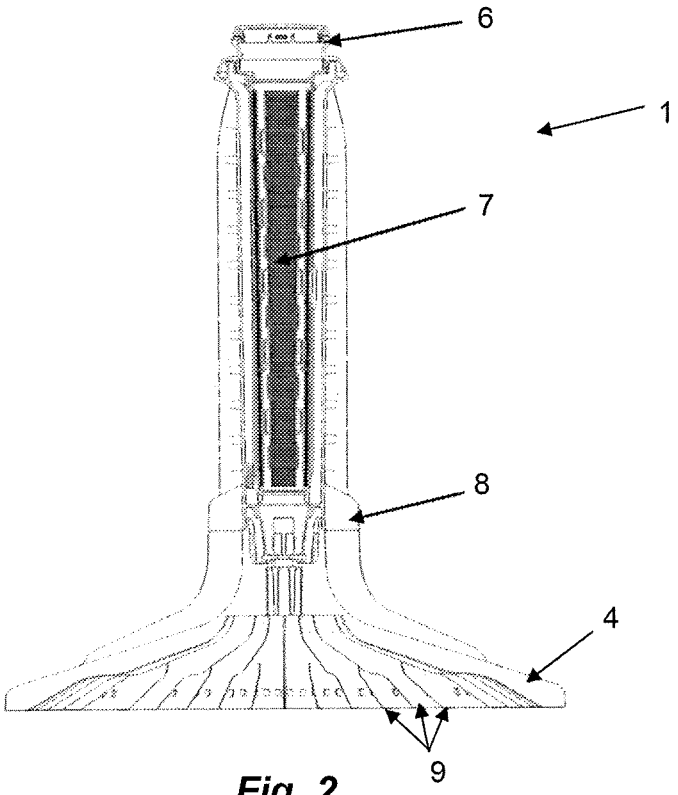
FIG. 2 shows a lateral cross-sectional view of the agitator shown in FIG. 1, comprising a filtration element 7 mounted therein.

The embodiment shown in FIGS. 1 and 2 comprises the intake opening 5 oriented so as to have the intake of the washing liquid increased as a function of the actual alternating rotary movement performed by the agitator 1. Thus, a flow of washing liquid is admitted with high efficiency, since the intake opening 5 admits the washing liquid immediately in front thereof, when the rotational movement of the agitator is performed.

In particular as shown by the embodiment of FIG. 2, the filtration element 7 extending along the length of the inner area of the agitator 1, comprising an enlarged filtration area, compared to the Prior Art filters, decreasing the loss of energy and allowing a greater flow of the washing liquid passing through the interior of the agitator 1.

Figure 3:
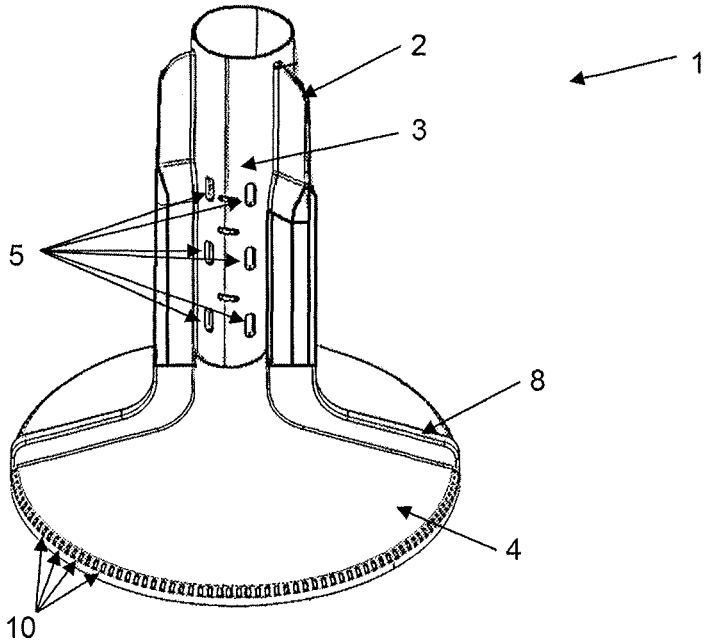
FIG. 3 shows an embodiment of the agitator of this utility model, comprising the intake openings 5 defined by openings in the cylindrical wall of the elongated body 3 of the agitator.

In the embodiment shown in FIG. 3, the intake opening 5 is as commonly used by the Prior Art, i.e., these are openings imposed on the surface of the cylindrical portion 3 of the hollow body of the agitator 1, so as to have the intake of washing liquid increased as a function of the pressure difference generated during the alternating rotational movement performed by the agitator 1.

Figure 4:
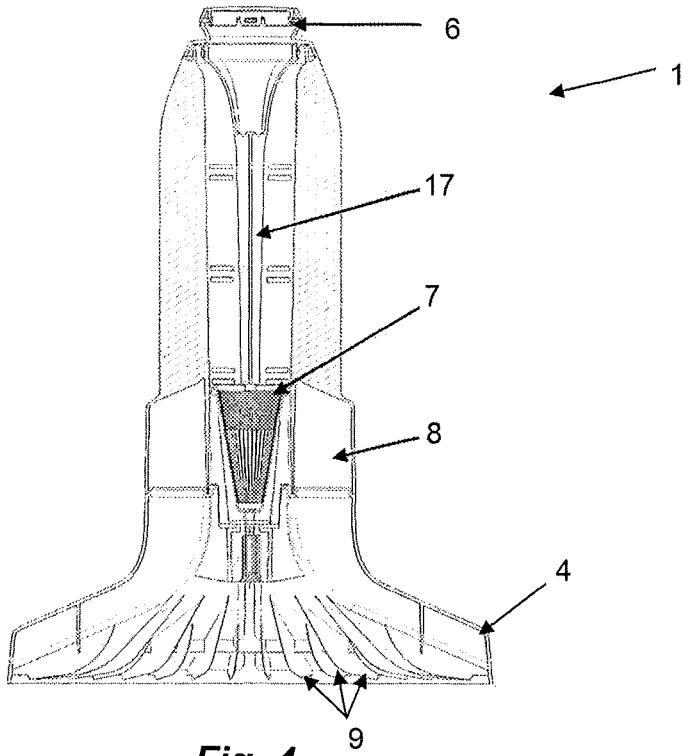
FIG. 4 shows a lateral cross-sectional view of the agitator shown in FIG. 3, comprising a filtration element 7 mounted therein.

As already discussed, the mechanical agitator 1 comprises a filtration element 7 mounted therein for performing the step of filtering and retaining lint and other objects and particles unsuitable for forming the medium of the washing liquid. The filtration element may be of any type from the Prior Art, for example the model shown in FIGS. 2 and 4, in which the filtration element 7 is fixed to the end of a rod 17.

As can be seen in FIGS. 1 to 4, the elongated body of the agitator 1 comprises external projections 2 placed along its length, which extend continuously to the base 4 of the agitator 1, where agitating projections 8 of the agitator 8 are defined on the base 4, for the purpose of increasing agitation of the washing liquid within the washing basket.

In yet another embodiment for optional use of this utility model, the base 4 of the agitator 1 comprises a plurality of radial vanes 9 spaced angularly from one another and placed in the lower portion of the base 4. In a preferred embodiment, the areas defined between each pair of radial vanes are communicating with the openings 10 of the base 4, so as to prepare an optimized flow of the washing liquid admitted through the intake openings 5 to flow back into the washing area.

Based on this placement, the combined operation of the vanes 9 with the openings 10, decrease the loss of energy in the movement of the washing liquid as it passes through the inside of the agitator 1, improving the flow of movement of said washing liquid and, consequently, the operation of the laundry washing machine.

This descriptive report, as well as the appended Figures, has the sole purpose of describing in detail the new provision introduced in the object of this utility model, so that the intended scope of protection should not be limited by description or drawings and the teachings herein will be appreciated and may construct variations which are within the scope of the appended Claims.

The invention claimed is:

1. An agitator for a laundry washing machine of the type comprising a washing basket that is configured to be loaded through an upper area thereof, the agitator being configured to fit inside the washing basket and comprising:

a base;

an elongated hollow body extending upwards from the base and having a plurality of intake openings located along a length of the elongated hollow body, for the admission of washing liquid;

a plurality of radial openings located on a radial periphery of the base; and a filtration element extending along the length of the internal area of the elongated hollow body, wherein, along the length of the elongated hollow body, the plurality of intake openings are in fluid communication with the filtration element, wherein the elongated hollow body comprises external projections placed along the length of the elongated hollow body and extending up from the base defining agitator projections, and wherein the plurality of intake openings are located on the external projections.

2. The agitator, in accordance with claim 1, wherein the base comprises an upper surface and a lower surface, with the elongated hollow body extending upwards from the upper surface, and a plurality of radial vanes extending from the lower surface, the plurality of radial vanes being angularly spaced between each other, with respective defined areas between each adjacent pair of radial vanes being in fluid communication with respective radial openings.

3. The agitator in accordance with claim 1, wherein the base extends radially outwards from the elongated hollow body.

4. An agitator for a laundry washing machine, the agitator comprising:

a base having an upper surface and a lower surface;

an elongated hollow body extending upwards from a central portion of the upper surface of the base and having a plurality of intake openings located along a length of the elongated hollow body for the admission of washing liquid and an interior chamber including a filter therein, the filter extending along the length of the internal area of the elongated hollow body, wherein, along the length of the elongated hollow body, the plurality of intake openings are in fluid communication with the filter;

a plurality of openings located on a radial periphery of the base; and a plurality of vanes extending from the lower surface of the base, with each adjacent pair of radial vanes forming a respective region in fluid communication with respective ones of the plurality of openings, wherein the elongated hollow body comprises external projections placed along the length of the elongated hollow body and extending up from the base defining agitator projections, and wherein the plurality of intake openings are located on the external projections.

5. A laundry washing machine comprising:

a washing basket having an opening configured to receive laundry, the opening facing upwards when the laundry washing machine is configured for use; and an agitator comprising:

a base located at a bottom end of the washing basket when the laundry washing machine is configured for use, the base having an upper surface and a lower surface;

an elongated hollow body extending upwards from a central portion of the upper surface of the base and having a plurality of intake openings located along a length of the elongated hollow body, for the admission of washing liquid and an interior chamber including a filter therein, the filter extending along the length of the internal area of the elongated hollow body, wherein, along the length of the elongated hollow body, the plurality of intake openings are in fluid communication with the filter;

a plurality of openings located on a radial periphery of the base; and a plurality of vanes extending from the lower surface of the base, with each adjacent pair of radial vanes forming a respective region in fluid communication with respective ones of the plurality of openings, wherein the elongated hollow body comprises external projections placed along the length of the elongated hollow body and extending up from the base defining agitator projections, and wherein the plurality of intake openings are located on the external projections.

* * * * *